US007465364B2

(12) United States Patent
Omura et al.

(10) Patent No.: US 7,465,364 B2
(45) Date of Patent: Dec. 16, 2008

(54) FE-CR-SI BASED NON-ORIENTED ELECTROMAGNETIC STEEL SHEET AND PROCESS FOR PRODUCING THE SAME

(75) Inventors: Takeshi Omura, Tokyo (JP); Masaaki Kohno, Tokyo (JP); Masaki Kawano, Tokyo (JP)

(73) Assignee: JFE Steel Corporation (JP)

( * ) Notice: Subject to any disclaimer, the term of this patent is extended or adjusted under 35 U.S.C. 154(b) by 457 days.

(21) Appl. No.: 10/538,501

(22) PCT Filed: Dec. 18, 2003

(86) PCT No.: PCT/JP03/16229

§ 371 (c)(1),
(2), (4) Date: Jun. 9, 2005

(87) PCT Pub. No.: WO2004/059022

PCT Pub. Date: Jul. 15, 2004

(65) Prior Publication Data

US 2006/0048859 A1 Mar. 9, 2006

(30) Foreign Application Priority Data

Dec. 24, 2002 (JP) ..... 2002-371942

(51) Int. Cl.
*H01F 1/16* (2006.01)

(52) U.S. Cl. ..... 148/307; 148/111; 148/113

(58) Field of Classification Search ..... None
See application file for complete search history.

(56) References Cited

U.S. PATENT DOCUMENTS 6,162,305 A 12/2000 Hsiao et al.
6,162,306 A * 12/2000 Takajo et al. ..... 148/309
7,140,417 B2 * 11/2006 Schoen et al. ..... 164/476
2004/0016530 A1 * 1/2004 Schoen et al. ..... 164/476
2005/0000596 A1 * 1/2005 Schoen et al. ..... 148/111

FOREIGN PATENT DOCUMENTS

EP 0 915 179 A2 5/1999
JP 52-24117 A 2/1977

(Continued)

*Primary Examiner*—John P. Sheehan
(74) *Attorney, Agent, or Firm*—DLA Piper LLP (US)

(57) ABSTRACT

An Fe—Cr—Si based non-oriented electrical steel sheet contains 2.5% to 10% by mass of Si, 1.5% to 20% by mass of Cr, 0.006% by mass or less of C, 0.002% by mass or less of N, 0.005% by mass or less of S, 0.005% by mass or less of Ti, 0.005% by mass or less of Nb, and as necessary, 0.1% to 2% by mass of Al and at least one of 0.005% to 1% by mass of Sb and 0.005% to 1% by mass of Sn, and the balance being Fe and incidental impurities, wherein the electrical resistivity of the steel is 60 μΩcm or more, and the number of nitrides containing chromium per $mm^2$ in the interior of the steel sheet is 2,500 or less. Consequently, the problem that high electrical resistance resulting from the high Si content and high Cr content is not satisfactorily utilized is advantageously solved, and it is possible to provide a non-oriented electrical steel sheet having excellent magnetic properties in the high-frequency range, in particular, in a frequency range of 1 kHz or more.

8 Claims, 5 Drawing Sheets

FOREIGN PATENT DOCUMENTS

| | | | |
|---|---|---|---|
| JP | 11 332183 | | 11/1999 |
| JP | 11-343544 | A | 12/1999 |
| JP | 2001 223105 | | 8/2001 |
| JP | 2001-223105 | A | 8/2001 |
| JP | 2001-262289 | A | 9/2001 |
| JP | 2001-279326 | A | 10/2001 |
| JP | 2001 279397 | | 10/2001 |
| JP | 2001 279399 | | 10/2001 |
| JP | 2002-226953 | | 8/2002 |

* cited by examiner

FE-CR-SI BASED NON-ORIENTED ELECTROMAGNETIC STEEL SHEET AND PROCESS FOR PRODUCING THE SAME

TECHNICAL FIELD

The present invention relates to Fe—Cr—Si based non-oriented electrical steel sheets for high-frequency use which are suitable for iron cores of electric car motors, power generators for gas microturbines, high-frequency reactors, etc. Herein, the term "high-frequency range" is defined as a frequency range of several hundred hertz or more, and in particular, of about 400 Hz or more. The present invention more particularly relates to a steel sheet having excellent magnetic properties in a high frequency range of 1 kHz or more.

BACKGROUND ART

Recently, devices used in the higher frequency ranges than conventionally used, for example, electric car motors, gas microturbines, and high-frequency reactors, have been increasingly used, and there has been a demand for electrical steel sheets having excellent magnetic properties in the high frequency range. These devices are used in a high frequency range of several hundred hertz to several tens of kilohertz.

Conventionally, in such applications, Fe—Si based non-oriented electrical steel sheets in which iron loss is improved (i.e., iron loss is decreased) by adding Si to steel have been used. In general, a non-oriented electrical steel sheet is cold-rolled so as to have a desired thickness, and is then recrystallized by final annealing to attain desired electromagnetic properties. However, in the conventional Fe—Si based non-oriented electrical steel sheet for high-frequency use, the Si content in the steel is 3.5% by mass or less, and the electrical resistance of the steel is not so high. In particular, in a high frequency range of 1 kHz or more, the iron loss is high, which is disadvantageous. Therefore, in order to meet the recent needs in society, development of new electrical steel sheets suitable for use in the high frequency range is absolutely necessary. In order to improve iron loss in the high frequency range, it is considered to be particularly effective to improve eddy current loss by increasing the electrical resistance of steel. In order to increase the electrical resistance of steel, a technique is commonly used in which the Si or Al content in the steel is increased. However, if the Si content exceeds 3.5% by mass, the steel becomes extremely hard and brittle, resulting in a deterioration in workability. Consequently, it becomes difficult to perform manufacture and working by ordinary rolling. Furthermore, in the conventional Fe—Si based steel sheet, for example, if the Si content exceeds 5.0% by mass, it becomes impossible to perform not only cold working but also warm working.

A technique for increasing the electrical resistance of steel by adding Cr, Al, etc., to steel without increasing the Si content is disclosed in Patent Document 1. However, in the technique disclosed in Patent Document 1, a frequency range of less than 1 kHz is assumed for use as in the conventional electrical steel sheet for high-frequency use, and it is not possible to obtain sufficient high-frequency magnetic properties in a frequency range of 1 kHz or more. Thus, the steel sheet disclosed in Patent Document 1 does not have a satisfactory effect as a non-oriented electrical steel sheet for high-frequency use suitable in the range of about 400 Hz to about 50 kHz required in recent years. Additionally, the Si content in Patent Document 1 does not exceed that of a typical silicon steel sheet, and rather, Patent Document 1 mainly targets a low-silicon steel sheet with a Si content of about 1.5%.

In contrast, the applicant of the present invention has found that by the addition of Cr, even in steel having a relatively high Si content, brittleness is improved, and thus both high electrical resistance and high workability are obtained. The applicant of the present invention has proposed Fe—Cr—Si based electrical steel sheets excellent in high-frequency magnetic properties with a Cr content of 1.5% to 20% by mass and a Si content of 2.5% to 10% by mass in Patent Documents 2, 3, 4, etc.

[Patent Document 1]: Japanese Unexamined Patent Application Publication No. 11-229095

[Patent Document 2]: Japanese Unexamined Patent Application Publication No. 11-343544

[Patent Document 3]: Japanese Unexamined Patent Application Publication No. 2001-262289

[Patent Document 4]: Japanese Unexamined Patent Application Publication No. 2001-279326

DISCLOSURE OF THE INVENTION

[Problems to be Solved by the Invention]

In the steel sheets described in Patent Documents 2, 3, etc., superior iron loss is shown in response to high electrical resistance in a frequency range of 10 kHz or more. On the other hand, it has been newly found that, although these steel sheets have better iron loss compared with the conventional electrical steel sheet in a high-frequency range of less than 10 kHz, satisfactory iron loss measuring up to the high electrical resistance due to the high Si content and the high Cr content is not obtained. Therefore, these steel sheets require further improvement.

Accordingly, it is an object of the present invention to advantageously solve the problem that the high electrical resistance obtained by the high Si content and the high Cr content is not sufficiently reflected to iron loss in a high-frequency range of less than 10 kHz and to provide an Fe—Cr—Si based non-oriented electrical steel sheet having excellent magnetic properties in the high-frequency range, in particular, in a frequency range of 1 kHz or more.

[Means for Solving the Problems]

As a result of intensive research into the problems described above, the present inventors have found that, although the percentage of eddy current loss in the iron loss is generally high in the high-frequency range, the influence of hysteresis loss is relatively large with respect to the Fe—Cr—Si based electrical steel sheet. It has been found that because of a deterioration of hysteresis loss, the decrease in eddy current loss due to high electrical resistance does not sufficiently contribute to high-frequency magnetic properties. It has been discovered that in order to obtain improved hysteresis loss, it is necessary to control the frequency of nitrides containing chromium (nitrides including chromium) in the interior of the steel sheet. The present invention has been achieved based on the findings described above.

The constituent features of the present invention are as follows:

(1) An Fe—Cr—Si based non-oriented electrical steel sheet having excellent high-frequency magnetic properties contains 2.5% to 10% by mass of Si, 1.5% to 20% by mass of Cr, 0.006% by mass or less of C, 0.002% by mass or less of N, 0.005% by mass or less of S, 0.005% by mass or less of Ti, 0.005% by mass or less of Nb, and the balance being Fe and incidental impurities, wherein the electrical resistivity of the steel is 60 μΩcm or more, and the number of nitrides containing chromium per $mm^2$ in the interior of the steel sheet is 2,500 or less.

(2) An Fe—Cr—Si based non-oriented electrical steel sheet having excellent high-frequency magnetic properties contains 2.5% to 10% by mass of Si, 1.5% to 20% by mass of Cr, 0.006% by mass or less of C, 0.002% by mass or less of N, 0.005% by mass or less of S, 0.005% by mass or less of Ti, 0.005% by mass or less of Nb, at least one of more than 0.04% to 1% by mass of Sb and more than 0.06% to 1% by mass of Sn, and the balance being Fe and incidental impurities, wherein the electrical resistivity of the steel is 60 μΩcm or more, and the number of nitrides containing chromium per $mm^2$ in the interior of the steel sheet is 2,500 or less.

(3) An Fe—Cr—Si based non-oriented electrical steel sheet having excellent high-frequency magnetic properties contains 2.5% to 10% by mass of Si, 1.5% to 20% by mass of Cr, 0.1% to 2% by mass of Al, 0.006% by mass or less of C, 0.004% by mass or less of N, 0.005% by mass or less of S, 0.005% by mass or less of Ti, 0.005% by mass or less of Nb, and the balance being Fe and incidental impurities, wherein the electrical resistivity of the steel is 60 μΩcm or more, and the number of nitrides containing chromium per $mm^2$ in the interior of the steel sheet is 2,500 or less.

(4) An Fe—Cr—Si based non-oriented electrical steel sheet having excellent high-frequency magnetic properties contains 2.5% to 10% by mass of Si, 1.5% to 20% by mass of Cr, 0.1% to 2% by mass of Al, 0.006% by mass or less of C, 0.004% by mass or less of N, 0.005% by mass or less of S, 0.005% by mass or less of Ti, 0.005% by mass or less of Nb, at least one of 0.005% to 1% by mass of Sb and 0.005% to 1% by mass of Sn, and the balance being Fe and incidental impurities, wherein the electrical resistivity of the steel is 60 μΩcm or more, and the number of nitrides containing chromium per $mm^2$ in the interior of the steel sheet is 2,500 or less.

(5) An Fe—Cr—Si based non-oriented electrical steel sheet having excellent high-frequency magnetic properties according to any one of the inventions (1) to (4) further contains at least one of 1% by mass or less of Mn and 1% by mass or less of P.

(6) A method for producing an Fe—Cr—Si based non-oriented electrical steel sheet having excellent high-frequency magnetic properties includes the steps of casting molten steel containing 2.5% to 10% by mass of Si and 1.5% to 20% by mass of Cr; subjecting the cast steel to rolling including cold rolling (including warm rolling, hereinafter the same); and subjecting the resulting rolled steel sheet to final annealing, wherein the nitriding gas content in the final annealing atmosphere is controlled to less than 30 percent by volume in total in terms of nitrogen gas.

Herein, contribution of the nitriding gas to nitriding is converted to the percent by volume in total in terms of nitrogen gas, which is calculated as follows. As the fraction of nitrogen N, the atomic ratio is determined from the chemical composition of each nitriding gas. The resulting ratio is multiplied by the volume percentage of each nitriding gas, and the total sum is calculated.

In the invention (6) or in any one of the inventions (7) to (9) which will be described below, preferably, the "step of rolling including cold rolling" includes the substeps of:

hot-rolling the cast steel slab;

subjecting the resulting hot-rolled sheet to annealing (also referred to as "hot-rolled sheet annealing") as necessary; and subjecting the hot-rolled sheet or annealed hot-rolled sheet to cold rolling once, or twice or more with annealing (referred to as "intermediate annealing") being interposed therebetween.

(7) A method for producing an Fe—Cr—Si based non-oriented electrical steel sheet includes the steps of casting molten steel containing 2.5% to 10% by mass of Si, 1.5% to 20% by mass of Cr, and at least one of more than 0.04% to 1% by mass of Sb and more than 0.06% to 1% by mass of Sn; subjecting the cast steel to rolling including cold rolling; and subjecting the resulting rolled steel sheet to final annealing, wherein the nitriding gas content in the final annealing atmosphere is controlled to less than 95 percent by volume in total in terms of nitrogen gas.

(8) A method for producing an Fe—Cr—Si based non-oriented electrical steel sheet includes the steps of casting molten steel containing 2.5% to 10% by mass of Si, 1.5% to 20% by mass of Cr, and 0.1% to 2% by mass of Al; subjecting the cast steel to rolling including cold rolling; and subjecting the resulting rolled steel sheet to final annealing, wherein the nitriding gas content in the final annealing atmosphere is controlled to less than 95 percent by volume in total in terms of nitrogen gas.

(9) A method for producing an Fe—Cr—Si based non-oriented electrical steel sheet includes the steps of casting molten steel containing 2.5% to 10% by mass of Si, 1.5% to 20% by mass of Cr, 0.1% to 2% by mass of Al, and at least one of 0.005% to 1% by mass of Sb and 0.005% to 1% by mass of Sn; subjecting the cast steel to rolling including cold rolling; and subjecting the resulting rolled steel sheet to final annealing, wherein the nitriding gas content in the final annealing atmosphere is controlled to less than 95 percent by volume in total in terms of nitrogen gas.

BEST MODE FOR CARRYING OUT THE INVENTION

First, the experimental results, from which the present invention was derived, will be described. The present inventors have studied the reasons for deterioration of hysteresis loss of Fe—Cr—Si based electrical steel sheets.

Each of steels 1 to 8 having the composition shown in Table 1 was subjected to hot rolling and cold rolling in the usual manner so as to have a thickness of 0.25 mm, and was then subjected to final annealing.

The final annealing conditions were set as follows. The annealing atmosphere was a nitrogen+hydrogen atmosphere ($N_2$:$H_2$=70:30 by volume ratio), and the annealing temperature was 980° C.

TABLE 1

| Steel ID | Composition (Weight basis) | | | | | | | | | | | |
|---|---|---|---|---|---|---|---|---|---|---|---|---|
| | C (ppm) | Si (%) | Mn (%) | P (ppm) | S (ppm) | Al (%) | N (ppm) | O (ppm) | Sb (%) | Ti (%) | Nb (%) | Cr (%) |
| 1 | 10 | 3.01 | 0.01 | 20 | 10 | 0.005 | 17 | 12 | ≦0.001 | ≦0.001 | ≦0.001 | 1.04 |
| 2 | 16 | 3.1 | 0.02 | 20 | 10 | 0.005 | 13 | 19 | ≦0.001 | ≦0.001 | ≦0.001 | 1.49 |
| 3 | 19 | 3.05 | 0.01 | 20 | 10 | 0.005 | 15 | 15 | ≦0.001 | ≦0.001 | ≦0.001 | 2.1 |
| 4 | 20 | 2.95 | 0.01 | 20 | 10 | 0.005 | 14 | 16 | ≦0.001 | ≦0.001 | ≦0.001 | 2.55 |
| 5 | 16 | 3.06 | 0.01 | 10 | 10 | 0.005 | 10 | 15 | ≦0.001 | ≦0.001 | ≦0.001 | 3.01 |
| 6 | 11 | 3.04 | 0.01 | 10 | 15 | 0.005 | 9 | 15 | ≦0.001 | ≦0.001 | ≦0.001 | 3.55 |
| 7 | 20 | 2.98 | 0.02 | 10 | 15 | 0.005 | 16 | 18 | ≦0.001 | ≦0.001 | ≦0.001 | 4.1 |
| 8 | 18 | 3.1 | 0.02 | 10 | 15 | 0.005 | 15 | 13 | ≦0.001 | ≦0.001 | ≦0.001 | 4.49 |
| 9 | 18 | 2.9 | 0.01 | 20 | 7 | 0.005 | 18 | 11 | 0.09 | ≦0.001 | ≦0.001 | 2.51 |
| 10 | 16 | 3.06 | 0.01 | 10 | 10 | 0.005 | 7 | 15 | 0.045 | ≦0.001 | ≦0.001 | 3.46 |
| 11 | 21 | 2.99 | 0.01 | 10 | 10 | 0.55 | 22 | 18 | ≦0.001 | ≦0.001 | ≦0.001 | 3.0 |
| 12 | 19 | 3.3 | 0.02 | 15 | 7 | 0.35 | 17 | 16 | 0.02 | ≦0.001 | ≦0.001 | 3.1 |

Figure 1:
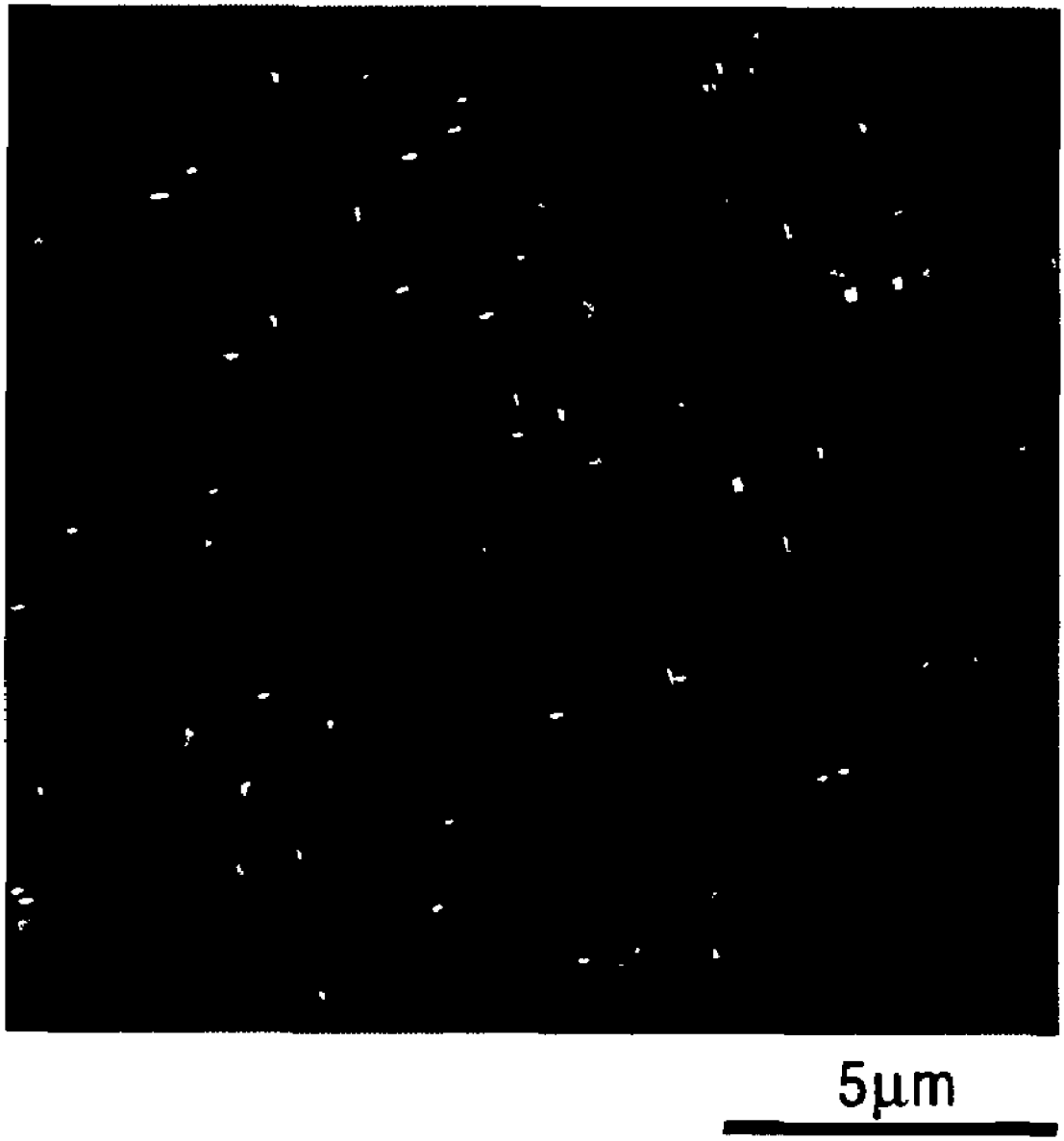
FIG. 1 is a cross-sectional SEM image showing fine precipitates of nitride containing chromium in the interior of an Fe—Cr—Si based non-oriented electrical steel sheet.

As a result, in each of the steel sheets produced by subjecting steels 1 to 8 to final annealing under the conditions described above, fine nitrides containing chromium having a diameter of about several hundreds of nanometers were observed in the steel. As an example, FIG. 1 is a cross-sectional SEM image, taken by a scanning electron microscope (SEM), of the interior of the steel sheet produced by subjecting steel 5 to final annealing under the conditions described above. Additionally, the nitrides containing chromium are believed to be mainly composed of CrN, $Cr_2N$, and carbonitrides, such as Cr(C,N).

Figure 2:
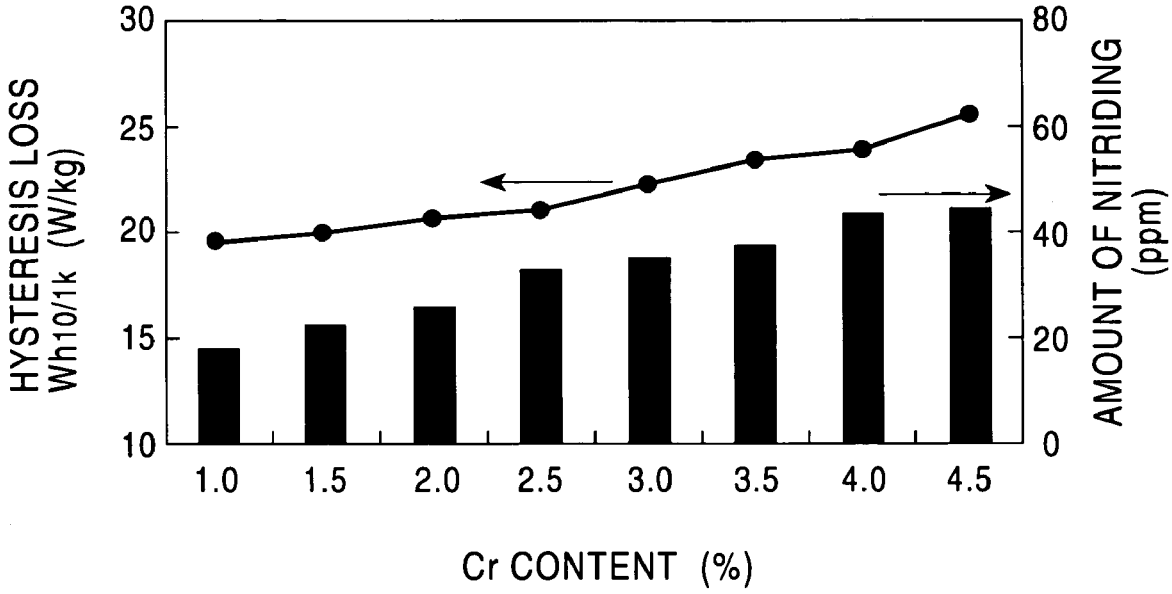
FIG. 2 is a graph in which the Cr content in steel is plotted as abscissa and the amount of nitriding during final annealing and hysteresis loss are plotted as ordinate to show an example of the relationship therebetween.

Next, these steels with various Cr contents in the range of 1.0% to 4.5% by mass were subjected to final annealing under the conditions described above. The amount of nitriding during final annealing (difference in nitrogen content before and after final annealing) and the hysteresis loss were measured. FIG. 2 is a graph in which the Cr content in steel is plotted as abscissa and the amount of nitriding (in the entire steel sheet) during final annealing and the hysteresis loss are plotted as ordinate to show the relationship therebetween. In FIG. 2, the bar chart represents the amount of nitriding, and the line chart represents the hysteresis loss. As is evident from FIG. 2, as the Cr content in steel increases, the amount of nitriding during final annealing increases, and the hysteresis loss deteriorates.

From the results described above, it is considered that Cr in steel is easily precipitated as nitride containing chromium by nitriding during final annealing, and that the precipitation of the nitride containing chromium deteriorates hysteresis loss. Consequently, the present inventors have studied the means of inhibiting the precipitation of nitrides containing chromium during final annealing. As a result, it has been found that by annealing in an atmosphere, such as in an Ar gas atmosphere, in which nitriding does not occur, precipitation of nitrides containing chromium can be inhibited. It has also been found that by adding Sb and Sn, which are nitriding inhibitors, and/or Al, which is a nitride former, to a raw steel product, and by annealing in an atmosphere in which the nitrogen partial pressure is controlled to meet the Sb, Sn, and Al contents, precipitation of nitrides containing chromium can be effectively inhibited. One example of this will be described below.

First, with respect to steel 10 having an Fe—Cr—Si alloy composition and containing 0.045% by mass of Sb shown in Table 1, a cold-rolled steel sheet was produced under the same conditions as those in the production method described above, and the cold-rolled steel sheet was subjected to final annealing in two atmospheres (i.e., nitrogen:hydrogen=0.70:30 and 95:5 by volume ratio).

Figure 3A:
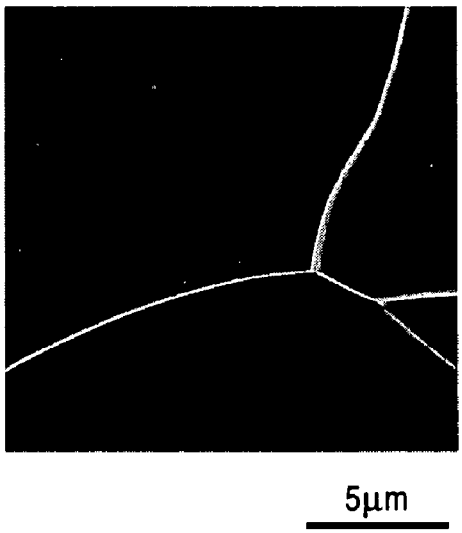
FIG. 3A is a cross-sectional SEM image showing the interior of an electrical steel sheet (added with Sb) according to the present invention after being subjected to final annealing.
Figure 3B:
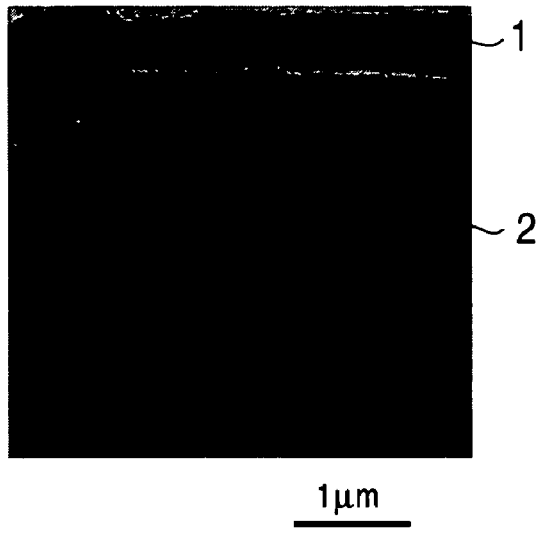
FIG. 3B is a cross-sectional SEM image showing a region near the surface of the electrical steel sheet (added with Sb) according to the present invention after being subjected to final annealing.

FIG. 3A is a cross-sectional SEM image showing the interior of the steel sheet subjected to final annealing in an atmosphere with a nitrogen:hydrogen ratio of 70:30, and FIG. 3B is a cross-sectional SEM image showing a region near the surface of the steel sheet. The observation conditions were the same as those for FIG. 1. As is evident from FIGS. 3A and 3B, precipitation of nitrides containing chromium in a steel sheet portion 2 is inhibited by the addition of Sb. Reference numeral 1 in FIG. 3B represents a Cu foil for protecting the surface.

With respect to the steel sheet subjected to final annealing in an atmosphere with a nitrogen:hydrogen ratio of 95:5, however, a considerable amount of nitrides containing chromium was observed in the grain boundaries. That is, even when annealing was performed in the atmosphere with the nitrogen:hydrogen ratio of 95:5, although the effect of inhibiting precipitation of nitrides containing chromium due to the addition of Sb was observed, the precipitation-inhibiting effect was insufficient.

Next, with respect to steel 11 having an Fe—Cr—Si alloy composition and containing 0.55% by mass of Al shown in Table 1, final annealing was performed similarly in two atmospheres (i.e., nitrogen:hydrogen=70:30 and 95:5). The other production conditions were the same as those in the production method described above.

Figure 4A:
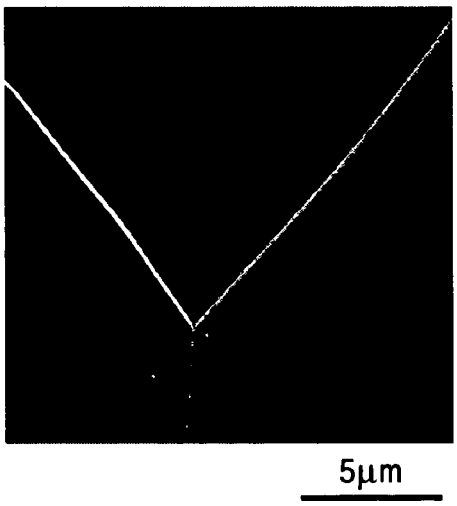
FIG. 4A is a cross-sectional SEM image showing the interior of another electrical steel sheet (added with Al) according to the present invention after being subjected to final annealing.
Figure 4B:
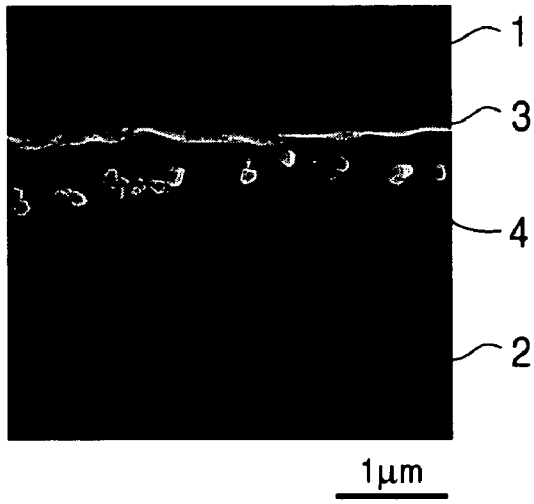
FIG. 4B is a cross-sectional SEM image showing a region near the surface of the electrical steel sheet (added with Al) according to the present invention after being subjected to final annealing.

FIG. 4A is a cross-sectional SEM image showing the interior of the steel sheet subjected to final annealing in an atmosphere with a nitrogen:hydrogen ratio of 70:30, and FIG. 4B is a SEM image showing a region near the surface of the steel sheet. As shown in FIG. 4B, an AlN layer 3 is formed on the outermost layer in the steel sheet, and precipitation of AlN 4 is observed in the region from the outermost layer to a depth of about 5 μm. As a result, as shown in FIG. 4A, precipitation of nitrides containing chromium is inhibited in the interior of the steel sheet.

In a final annealing atmosphere with a nitrogen:hydrogen ratio of 95:5, however, nitrides containing chromium were present in the grain boundaries, and it was confirmed that the precipitation-inhibiting effect was insufficient.

Although observation was performed with respect to the cross section cut in the rolling direction (i.e., the section in the rolling direction), no particular difference was observed in the number of particles depending on the cutting direction.

TABLE 2

| Steel ID | Thickness (mm) | Final annealing conditions: Annealing atmosphere (by volume ratio) | Final annealing conditions: Annealing temperature (° C.) | Amount of nitriding (ppm) | Hysteresis loss $Wh_{10/1k}$ (W/kg) | Number of nitrides containing chromium (per $mm^2$) |
|---|---|---|---|---|---|---|
| 1 | 0.25 | $N_2$:$H_2$ = 70:30 | 980 | 18 | 19.7 | $1.2 \times 10^4$ |
| 2 | 0.25 | $N_2$:$H_2$ = 70:30 | 980 | 22 | 20.2 | $3.5 \times 10^4$ |
| 3 | 0.25 | $N_2$:$H_2$ = 70:30 | 980 | 26 | 20.9 | $7.0 \times 10^4$ |
| 4 | 0.25 | $N_2$:$H_2$ = 70:30 | 980 | 33 | 21.3 | $1 \times 10^5$ |
| | 0.25 | Ar | 980 | −7 | 12.5 | <100 |
| 5 | 0.25 | $N_2$:$H_2$ = 70:30 | 980 | 35 | 22.5 | $3.1 \times 10^5$ |
| 6 | 0.25 | $N_2$:$H_2$ = 70:30 | 980 | 38 | 23.7 | $5.5 \times 10^5$ |
| | 0.25 | Ar | 980 | −3 | 13.3 | <100 |
| 7 | 0.25 | $N_2$:$H_2$ = 70:30 | 980 | 44 | 24.2 | $8 \times 10^5$ |
| 8 | 0.25 | $N_2$:$H_2$ = 70:30 | 980 | 45 | 25.8 | $1.1 \times 10^6$ |
| 9 | 0.25 | $N_2$:$H_2$ = 70:30 | 980 | 2 | 13.9 | 2,000 |
| 10 | 0.25 | $N_2$:$H_2$ = 70:30 | 980 | 0 | 13.4 | 1,000 |
| | 0.25 | $N_2$:$H_2$ = 95:5 | 980 | 13 | 19.2 | 6,500 |
| 11 | 0.25 | $N_2$:$H_2$ = 70:30 | 980 | 34 | 12.9 | <100 |
| | 0.25 | $N_2$:$H_2$ = 95:5 | 980 | 31 | 19.5 | 7,500 |
| 12 | 0.25 | $N_2$:$H_2$ = 70:30 | 980 | 4 | 13.4 | <100 |

Furthermore, with respect to steels 4 and 6 containing substantially no Sb or Al shown in Table 1, cold-rolled steel sheets were produced under the same conditions, and annealing was performed in an atmosphere containing only an Ar gas. In such a case, it was also confirmed that nitriding of the steel was inhibited and precipitation of nitrides containing chromium was inhibited.

When Sb and Al were added together (steel 12 in Table 1), by a similar experiment, it was confirmed that the same effect of inhibiting precipitation of nitrides containing chromium as that in the case of addition of only Sb or Al was obtained with a smaller amount of each added.

Furthermore, an Fe—Cr—Si based alloy steel added with Sn was prepared separately, and a similar experiment was carried out. As a result, it was confirmed that Sn had the same nitriding inhibiting effect as that of Sb.

Table 2 shows the number of nitrides containing chromium per $mm^2$ in the interior of the steel sheet, the amount of nitriding (in the entire steel sheet) after annealing, and the hysteresis loss measured with respect to non-oriented electrical steel sheets produced using any one of steels 1 to 12. The atmosphere and temperature of final annealing are shown in Table 2, and the other production conditions were the same as those for the steel sheet shown in FIG. 1, etc.

The number of nitrides containing chromium per $mm^2$ in the interior of the steel sheet was determined by the method described below.

With respect to a cross section obtained by cutting the steel sheet in the thickness direction, multiple fields were observed with a SEM (at a magnification of 1,000 to 10,000) so that the total observation area was 1 mm×1 mm. The number of nitrides containing chromium in the observation area was counted as the number of nitrides containing chromium per $mm^2$. In order to check whether the precipitates observed were Cr-containing nitrides or not, EDX was performed. The interior of the steel sheet is defined as a region excluding the region from the uppermost surface to a depth of 5 μm at each of front and back surfaces.

Figure 5:
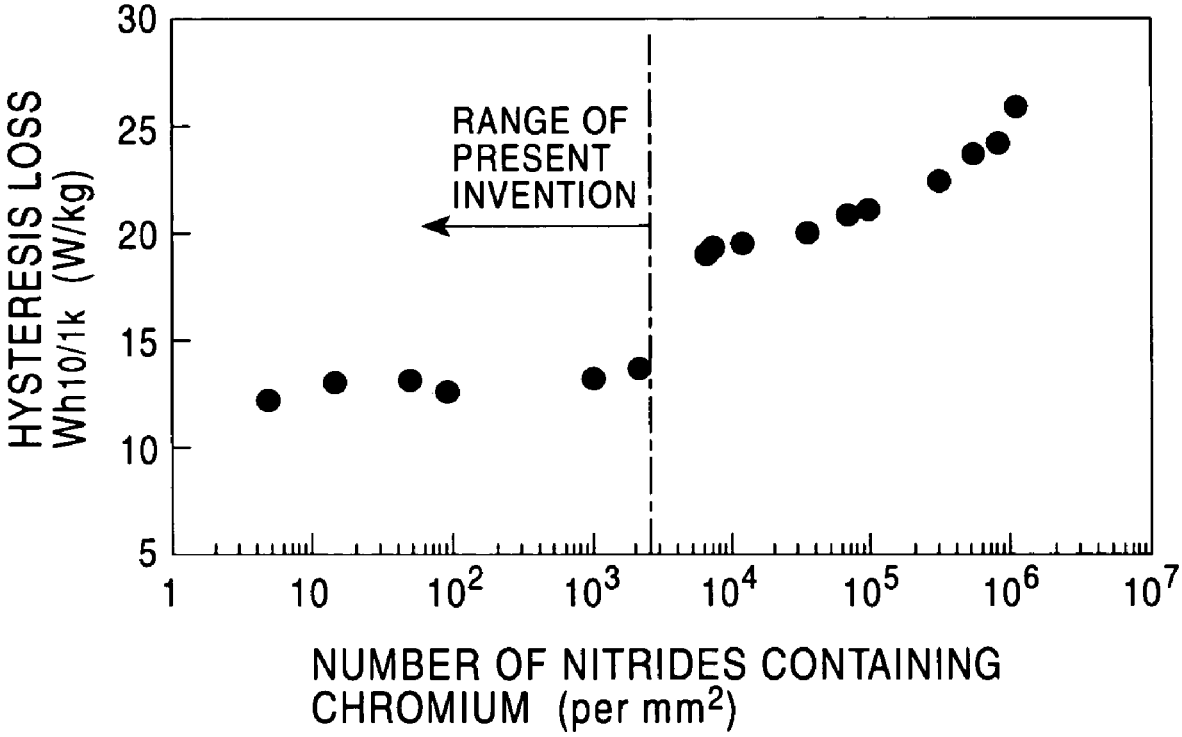
FIG. 5 is a graph showing a relationship between the number of nitrides containing chromium in the interior of the steel sheet (plotted as abscissa) and the hysteresis loss (plotted as ordinate) with respect to various steel sheets.

FIG. 5 is a graph showing the relationship between the number of nitrides containing chromium in the interior of the steel sheet and the hysteresis loss. It has been found that in order to obtain satisfactory hysteresis loss, the number of nitrides containing chromium per $mm^2$ must be controlled to 2,500 or less. The present invention has been achieved based on the above finding.

The non-oriented electrical steel sheets according to the present invention have the following characteristics.

(a) Brittleness of high Si steel is improved by the addition of Cr, and thereby it becomes possible to produce high Si steel which has conventionally been difficult to produce, and higher electrical resistance is obtained.

(b) Cr is effective not only in improving brittleness but also in increasing electrical resistance, and addition of Si together with Cr makes it possible to efficiently obtain high electrical resistance.

(c) By sufficiently decreasing the concentration of impurities, such as C, N S, Ti, and Nb, the brittleness-improving effect due to the addition of Cr is obtained, and a deterioration of hysteresis loss due to precipitates can be prevented.

(d) By annealing Cr—Si steel in an atmosphere, such as in an Ar gas atmosphere, in which nitriding does not occur, nitriding is inhibited, and the number of nitrides containing chromium precipitated can be controlled to 2,500 per $mm^2$ or less, thus preventing a deterioration of hysteresis loss due to nitrides containing chromium.

(e) By adding Sb and/or Sn, which are nitriding inhibitors, to an Fe—Cr—Si based electrical steel sheet and by adjusting the nitriding gas content so as to be suited to the content of Sb and/or Sn, nitriding is inhibited during annealing, and the number of nitrides containing chromium precipitated can be controlled to 2,500 per $mm^2$ or less, thus preventing a deterioration of hysteresis loss due to nitrides containing chromium.

(f) By adding Al, which is a nitride former, to an Fe—Cr—Si based electrical steel sheet and by adjusting the nitriding gas content so as to be suited to the Al content, nitriding of the sheet interior is inhibited during annealing, and the number of nitrides containing chromium precipitated can be controlled to 2,500 per $mm^2$ or less, thus preventing a deterioration of hysteresis loss due to nitrides containing chromium.

(g) When both Sb and/or Sn, which are nitriding inhibitors, and Al, which is a nitride former, are added to an Fe—Cr—Si based electrical steel sheet, nitriding is inhibited during annealing as in the steel in which any one of Sb, Sn, and Al is added alone with a smaller amount of each added, and by further adjusting the nitriding gas content appropriately, the number of nitrides containing chromium precipitated can be controlled to 2,500 per $mm^2$ or less, thus preventing a deterioration of hysteresis loss due to nitrides containing chromium.

The present invention will be described in detail below.

First, the reasons for limitations on the ranges of composition in the non-oriented electrical steel sheets of the present invention will be described.

Si: about 2.5% to about 10% by mass

Si is a principal element for increasing the electrical resistance of steel. Furthermore, due to the synergic effect with Cr, Si significantly increases electrical resistance, and in particular, Si is an effective element for improving iron loss in the high frequency range. If the Si content is less than about 2.5% by mass, even if Cr is used together, only an electrical resistance that is substantially the same as the electrical resistance of the conventional electrical steel sheet is obtained, and thus it is not possible to obtain satisfactory iron loss in the high frequency range. On the other hand, if the Si content exceeds about 10% by mass, even if Cr is added, toughness that normally allows the steel to be rolled is not ensured. Therefore, the Si content is set at about 2.5% to about 10% by mass. The upper limit may be set at 10.0% by mass.

The Si content is preferably in a range of about 2.5% to about 5.0%, and more preferably in a range of about 3.5% to about 5.0%.

Cr: about 1.5% to about 20% by mass

Cr is a basic alloy element which significantly increases the resistivity of steel due to the synergic effect with Si, and which improves corrosion resistance. In order to obtain such effects, the Cr content must be about 1.5% by mass or more.

Even when the Si content is about 3.5% by mass or more or the Si content is about 3% by mass or more and the Al content exceeds about 0.5% by mass, Cr is significantly effective in achieving toughness that normally allows the steel to be rolled. Although such an effect can be obtained at a Cr content of about 1.5% by mass or more, preferably, the Cr content is about 2% by mass or more. Additionally, even when the Si content and the Al content are lower than those described above, workability is improved by the addition of Cr. On the other hand, if the Cr content exceeds about 20% by mass, the toughness-improving effect is saturated and cost increase occurs. Therefore, the Cr content is set at about 1.5% to about 20% by mass. The upper limit may be 20.0% by mass.

The Cr content is preferably in a range of about 1.5% to about 5.0%.

At least one of Sb: more than 0.04% to about 1% by mass and Sn: more than 0.06% to about 1% by mass (in the case when 0.1% by mass or more of Al is not added to steel)

At least one of Sb: about 0.005% to about 1% by mass and Sn: about 0.005% to about 1% by mass (in the case when 0.1% by mass or more of Al is added to steel)

Since each of Sn and Sb has a nitriding-inhibiting effect, in steel containing these elements, precipitation of nitrides containing chromium can be effectively inhibited, compared with steel not containing Sn or Sb, even if the percentage of nitriding gas is high during final annealing. Since the precipitation of nitrides containing chromium due to nitriding during annealing is inhibited and deterioration of hysteresis loss is prevented, addition of Sn and/or Sb to an Fe—Cr—Si based electrical steel sheet produces a higher iron loss-improving effect compared with the conventional electrical steel sheet. Consequently, in the present invention, in the case of an electrical steel sheet in which Al is not added to steel (i.e., when the Al content is less than 0.1% by mass), at least one of more than 0.04% to about 1% by mass of Sb and more than 0.06% to about 1% by mass of Sn can be added. That is, if each of Sn and Sb exceeds 1% by mass, the effect described above is saturated and cost increase occurs. Therefore, the upper limit is set at 1% by mass. In order to produce the effect described above satisfactorily, the lower limits of the Sb and Sn contents are respectively set at more than 0.04% by mass and more than 0.06% by mass. Additionally, the upper limit of each of the Sb content and the Sn content may be set at 1.0% by mass.

On the other hand, when Al is also added together with Sn and/or Sb (i.e., when the Al content is 0.1% by mass or more), at least one of about 0.005% to about 1% by mass of Sb and about 0.005% to about 1% by mass of Sn can be added. If each of the Sn content and the Sb content exceeds about 1% by mass, the effect is saturated and cost increase occurs. Therefore, the upper limit is set at about 1% by mass. Additionally, the upper limit may be set at 1.0% by mass.

At a lower limit of about 0.005% by mass, due to the synergic effect with Al, the same effect as that described above is produced. The lower limit may be set at 0.0050% by mass.

Each of Sn and Sb has a texture-improving effect in addition to the nitriding-inhibiting effect, thereby further contributing to improvement in magnetic properties of the steel sheet. Although addition of Sn or Sb in such a purpose is not prohibited in Patent Documents 3 and 4, neither document suggests the amount or method optimized for inhibiting nitriding.

When Al is added together with Sn and/or Sb, each of the Sb content and the Sn content is more preferably about 0.005% to about 0.05%.

Al: about 0.1% to about 2% by mass

Al is a stronger nitride former than Cr, bonds with nitrogen entering from the surface of the steel sheet during annealing, forms an AlN layer on the outermost layer in the steel sheet, and further precipitates AlN in the vicinity of the surface beneath the outermost layer. Thereby, penetration of nitrogen into the interior of the steel sheet is prevented, and as a result, precipitation of nitrides containing chromium due to nitriding in the interior of the steel sheet can be inhibited. Therefore, Al can be added to the steel as necessary. In the conventional electrical steel sheet, it was considered that precipitation of AlN at the surface of the steel sheet should be inhibited because of deterioration of magnetic properties. However, with respect to the Fe—Cr—Si based electrical steel sheet, it has been found that the precipitation of AlN is very effective in improving magnetic properties. Furthermore, because of the addition of Al, nitrogen contained in the steel since the casting operation forms coarse AlN, and thereby precipitation of nitrides containing chromium due to nitrogen contained since the casting operation is also inhibited. These effects are obtained by an Al content of about 0.1% by mass or more.

Additionally, by adding an excessive amount of Al, electrical resistance can be increased, which is advantageous, and for example, in Patent Documents 1, 2, 3, and 4, addition of Al for this purpose is encouraged. However, the deterioration of magnetic flux density becomes larger compared with the case in which Si is added. Since an increase in electrical resistance can be achieved by combined addition of Si and Cr, from the standpoint that both high electrical resistance and high magnetic flux density are achieved, a lower Al content within the required range is preferred. Furthermore, since addition of an excessive amount of Al causes deterioration of toughness, a lower Al content is preferred in view of productivity. For the reasons described above, the upper limit of the Al content is set at about 2% by mass. The upper limit may be set at 2.0% by mass. Therefore, the Al content is set at about 0.1% to about 2% by mass. Preferably, the Al content is set at about 0.10% to about 1.0% by mass.

At least one of about 1% by mass or less of Mn and about 1% by mass or less of P By adding Mn and P, electrical resistance can be further increased, and further improvement in iron loss can be achieved without impairing the purpose of the present invention. Consequently, at least one of Mn and P may be added as necessary. However, if large amounts of these elements are added, workability is deteriorated. Therefore, the upper limit of each of the Mn content and the P content is set at about 1% by mass. (The upper limit may be set at 1.0% by mass.) Preferably, each of the Mn content and the P content is 0.5% by mass or less. Additionally, since a very small amount of Mn or P can provide the effect, it is not necessary to particularly set the lower limit. For example, an Mn content of about 0.04% by mass or more and a P content of about 0.01% by mass or more are sufficient.

C: about 0.006% by mass or less

Since C deteriorates the toughness of the Fe—Cr—Si based electrical steel sheet, the C content is desirably decreased as much as possible. In the compositional range of the present invention, the C content must be suppressed to about 0.006% by mass or less. Furthermore, in view of preventing the deterioration of hysteresis loss due to precipitates of Cr-containing carbides and the like, the C content must also be suppressed to about 0.006% by mass or less. The upper limit may be set at 0.0060% by mass. The C content is preferably about 0.0040% or less.

Although not adding C is theoretically acceptable, about 10 ppm of C is considered to remain in reality.

A steel ingot with a target C content may be cast. Alternatively, a steel ingot with about 0.006% to about 0.02% by mass of C used as a starting material may be subjected to C content reduction, such as intermediate annealing during cold rolling, or final annealing after cold rolling, conducted as a decarbonization annealing.

N: about 0.002% by mass or less (in the case when 0.1% by mass or more of Al is not added to steel) about 0.004% by mass or less (in the case when 0.1% by mass or more of Al is added to steel)

N readily bonds with Cr to precipitate nitrides containing chromium. Consequently, in view of deterioration of hysteresis loss, in the case of an electrical steel sheet in which Al is not added to steel (Al<0.1% by mass), the N content must be reduced to about 0.002% by mass or less. The upper limit may be set at 0.0020% by mass.

On the other hand, in the case of an electrical steel sheet in which Al is added to steel (Al≧0.1% by mass), N bonds with Al, and precipitation of nitrides containing chromium due to nitriding and nitrogen in steel is inhibited. Consequently, an N content of about 0.004% by mass or less is acceptable. However, since an increase in the N content causes deterioration of toughness, the N content is desirably reduced as much as possible. From the standpoint of deterioration of toughness, the N content must also be reduced to about 0.004% by mass or less. The upper limit may be set at 0.0040% by mass.

Although not adding N is theoretically acceptable, about 10 ppm of N is considered to remain in reality.

S: about 0.005% by mass or less

S produces precipitates, such as MnS and CuS, and deteriorates hysteresis loss. Consequently, in view of improvement in hysteresis loss, the S content must be reduced to about 0.005% by mass or less. The upper limit may be set at 0.0050% by mass. Preferably, the S content is about 0.0025% by mass or less. Although not adding S is theoretically acceptable, about 5 ppm of S is considered to remain in reality.

Ti: about 0.005% by mass or less, Nb: about 0.005% by mass or less

Ti and Nb are considered as workability-improving components in ordinary Cr-containing steel. However, Ti and Nb deteriorate magnetic properties. In the present invention, since workability is improved by the addition of Cr and reductions in the contents of C and N, workability improvement capabilities of Ti and Nb are not required. Therefore, in view of magnetic properties, the contents of Ti and Nb are desirably reduced as much as possible. The contents of Ti and Nb each must be reduced to about 0.005% by mass or less. The upper limit may be set at 0.0050% by mass. Preferably, each of the Ti content and the Nb content is about 0.0020% or less. Although not adding (below analytical limit of detection) these elements is theoretically acceptable, about 5 ppm each of Ti and Nb is considered to remain in reality.

With respect to incidental impurities, such as O, V, and Cu, in view of magnetic properties and workability, the contents thereof are desirably reduced as much as possible. Preferably, the contents of 0, V, and Cu are, respectively, 0.0050% by mass or less, 0.0050% by mass or less, and 0.050% by mass.

Examples of the other incidental impurities include B, Ni, Zr, Ca, and Mg. Preferably, the Ni content is 0.05% by mass or less, and the contents of the other elements are 0.0050% by mass or less.

In order to improve high-frequency characteristics, it is very effective to increase electrical resistance of steel. In the present invention, preferably, steel has an electrical resistivity of at least about 60 μΩcm. If the electrical resistivity is less than 60 μΩcm, high-frequency magnetic properties are not sufficiently obtained. Further, the electrical resistivity of less than 60 μΩcm is easily attained by a conventional electrical steel sheet in which Cr is not positively added. More preferably, the electrical resistivity is about 70 μΩcm or more.

Since the electrical resistivity is mainly determined by the composition of steel, the target-value is obtained by designing the composition with known influences of the individual elements in mind or by simple test.

As shown in FIG. 5, in order to obtain satisfactory hysteresis loss, the number of nitrides containing chromium per $mm^2$ in the interior of the steel sheet must be controlled to 2,500 or less. If the number of particles exceeds 2,500 per $mm^2$, the hysteresis loss rapidly deteriorates, and it is not possible to obtain satisfactory high-frequency iron loss.

The number of nitrides containing chromium per $mm^2$ is controlled to 2,500 or less by the addition of Sn and Sb, which are nitriding inhibitors, or Al, which is a nitride former, and further by increasing the proportion of non-nitriding gas in the final annealing atmosphere. Of course, this can be achieved by a 100% non-nitriding gas atmosphere.

Examples of the non-nitriding gas include $H_2$ gas and Ar gas. Examples of practically usable nitriding gas include $N_2$ gas and $NH_3$ gas.

With respect to steel having a composition in which nitriding inhibitors Sn and Sb or nitride former Al are not added, it is suitable to perform annealing in a non-nitriding atmosphere not containing a nitriding gas. The number of nitrides containing chromium can also be reduced by greatly decreasing the proportion of nitriding gas.

Next, processes for producing non-oriented electrical steel sheets of the present invention will be described below.

First, molten steel having a composition according to any one of the claims of the present invention is cast into a slab, and the slab is heated and then subjected to ordinary hot rolling. The slab heating temperature is not particularly limited, but is preferably set in a range of about 950° C. to about 1,200° C. because production problems, such as sagging of the slab, may occur if the slab is heated at high temperatures. By setting the thickness of the hot-rolled sheet to be extremely small, the rolling property of the steel sheet in the subsequent cold rolling step can be improved. On the other hand, if the thickness is excessively small, the rolling machine may fail in its ability to follow the decreased thickness or the shape of the hot-rolled sheet may become defective. Therefore, the thickness of the hot-rolled sheet is preferably in a range of about 2.5 mm to about 0.5 mm.

Subsequently, hot-rolled sheet annealing may be performed. The hot-rolled sheet annealing treatment is effective in improving magnetic properties. If the annealing temperature is less than 800° C., the effect is insufficient. If the annealing temperature exceeds 1,200° C., the texture becomes too coarse, resulting in a toughness problem. Therefore, preferably, hot-rolled sheet annealing is performed in a temperature range of about 800° C. to about 1,200° C.

The resultant hot-rolled sheet is then cold-rolled so as to have a final thickness. The cold rolling process may be performed one time to obtain the final thickness. Alternatively, the cold rolling process may be divided into two or more operations with intermediate annealing being interposed therebetween. The intermediate annealing treatment is effective in improving magnetic properties, removes strain from the steel sheet, and reduces the load in the subsequent cold rolling process. However, after strain is removed and recrystallization is completed, intermediate annealing deteriorates the toughness of the steel sheet. That is, intermediate annealing at extremely high temperatures not only saturates the effect but also produces coarse grains, thus degrading the cold rolling property of the steel sheet in the subsequent step. On the other hand, if the temperature is excessively low, the effect of improving magnetic properties becomes insufficient. Therefore, the intermediate annealing temperature is preferably in a range of 700° C. to 1,100° C.

The more the C content is reduced, the more magnetic properties and workability are improved. Consequently, the intermediate annealing process may be performed in an oxidizing atmosphere so that decarbonization is carried out.

Furthermore, the cold rolling process may be performed as warm rolling at a temperature in a range of about 100° C. to about 300° C. within which it is known that a magnetic improving effect is produced.

A typical production process has been described above. However, the production process is not limited thereto. Any process in which cast steel is subjected to working, finally by cold rolling or warm rolling, so as to have a final thickness may be performed under appropriate conditions.

The cold-rolled steel sheet which has been subjected to cold rolling (or warm rolling) is then subjected to final annealing to induce recrystallization. The final annealing process may be continuous annealing or box annealing. Preferably, continuous annealing is performed.

In the final annealing step for a non-oriented electrical steel sheet, a reducing atmosphere composed of nitrogen gas or including nitrogen gas as a main component mixed with hydrogen gas is generally used.

In the steel of the present invention, as already mentioned above, control of the atmosphere during final annealing is important. In order to inhibit nitriding and to control the number of nitrides containing chromium per $mm^2$ to 2,500 or less, for example, annealing is preferably performed in an atmosphere, such as in an Ar gas atmosphere, in which nitriding does not occur. Alternatively, Sb and Sn, which are nitriding inhibitors, and/or Al, which is a nitride former, may be added to a raw steel product, and the fraction of nitriding gas may be appropriately controlled to meet the contents of these additives. That is, in the present invention, the number of nitrides containing chromium precipitated per $mm^2$ is controlled to 2,500 or less by increasing the percentage of hydrogen gas in an atmosphere composed of nitrogen and hydrogen gases, or by replacing at least a part of nitrogen gas with the other gas, such as Ar gas. In particular, with respect to steel having the composition in which nitriding inhibitors Sn and Sb and nitride former Al are not added, the number of nitrides containing chromium precipitated per $mm^2$ is controlled to 2,500 or less by not using nitrogen gas in the annealing atmosphere or by reducing the percentage of nitrogen gas to a significantly low fraction.

Specifically, when the atmosphere is controlled, with respect to steel having the composition in which Al, Sb, and Sn are not added, the nitriding gas content in the atmosphere is controlled to less than 30 percent by volume in total in terms of nitrogen gas (hereinafter simply referred to as "percent by volume in total"). With respect to steel having the composition other than that described above, the nitriding gas content is controlled to less than 95 percent by volume in total. If the nitriding gas content is too high, it becomes difficult to control the precipitates due to nitriding, and further, the surface of the steel sheet is oxidized, resulting in a deterioration of hysteresis loss.

With respect to the nitriding gas content, the percent by volume in total in terms of nitrogen gas is calculated as follows. As the fraction of nitrogen N, the atomic ratio is determined from the chemical composition of each nitriding gas. The resulting ratio is multiplied by the volume percentage of each nitriding gas, and the total sum is calculated.

For example, when $N_2$:$NH_3$:$H_{2=40:40:20}$, since $NH_3$ consists of one nitrogen atom and three hydrogen atoms, the fraction of nitrogen N in $NH_3$ gas is 0.25. Therefore, the percent by volume in total in terms of nitrogen gas is calculated as follows: 40%+(40%×0.25)=50%.

In the case of $N_2$ gas, of course, the fraction of nitrogen is 1. Consequently, when the nitriding gas is composed of nitrogen gas only, the percent by volume of the nitrogen gas in the entire atmosphere corresponds to the percent by volume in total.

Furthermore, the nitriding ability is higher in higher-temperature annealing, and the effect of controlling the atmosphere is more remarkable when the final annealing temperature is higher than a temperature range of about 900° C. to 950° C. Preferably, controlling of the atmosphere is optimized appropriately based on the actual amount of nitriding at each final annealing temperature.

For example, in the final annealing temperature range from about 700° C. to less than 950° C., since the nitriding ability is not so high, in order to reduce the number of nitrides containing chromium to the predetermined value or less, the percent by volume in total of the nitriding gas is preferably set at less than 95% with respect to steel in which at least one of Sb, Sn, and Al is added, —and at less than 30% with respect to steel in which Sb, Sn, and Al are not added.

In the final annealing temperature range from 950° C. to about 1,150° C., since the nitriding ability is very high, preferably, the percent by volume in total of the nitriding gas is set to be lower than that in the case of low-temperature annealing. In such a case, the percent by volume in total of the nitriding gas is preferably set at about 80% or less with respect to steel in which at least one of Sb, Sn, and Al is added, and at about 15% or less with respect to steel in which Sb, Sn, and Al are not added. In view of cost and productivity, preferably, an appropriate amount of nitrogen gas is added to the atmosphere. With respect to steel in which at least one of Sb, Sn, and Al is added, nitrogen gas can be added to such a degree that the percent by volume in total of the nitriding gas is about 0.60% or more without problems. With respect to steel in which Sb, Sn, and Al are not added, nitrogen gas can be added to such a degree that the percent by volume in total of the nitriding gas is about 5% or more.

In the steel sheet of the present invention, if the thickness is decreased, the effect of improving high-frequency magnetic properties is accelerated. In order to obtain a remarkable effect of the decrease in thickness, preferably, the thickness is set at about 0.4 mm or less. However, if the thickness is smaller than about 0.01 mm, the production cost increases. Therefore, the thickness is preferably in a range of about 0.01 to about 0.4 mm.

EXAMPLES

Example 1

Steels each containing the composition shown in Table 3 and the balance being Fe and incidental impurities were cast, the resulting slabs were heated at 1,150° C. and hot-rolled to produce hot-rolled sheets with a thickness of 2.0 mm. Next, steels A to P and W were subjected to hot-rolled sheet annealing at 1000° C., and the final thickness was set at 0.25 mm by a single cold rolling process. On the other hand, steels Q to V were not subjected to hot-rolled sheet annealing, and the final thickness was set at 0.15 mm by a double cold rolling process including intermediate annealing at 900° C. Each steel sheet was subjected to final annealing at 980° C. to 1,040° C. for 10 seconds. The resulting steel sheet was cut into an Epstein sample and magnetic properties thereof were evaluated. The measurement was performed in accordance with JIS C 2550.

The electrical resistivity, thickness of the product, atmosphere gas in final annealing, annealing temperature, iron loss, amount of nitriding in the entire steel sheet after annealing, amount of nitriding in the interior of the steel sheet, nitrogen content in the interior of the steel sheet, and the number of nitrides containing chromium precipitated are summarized in Tables 4 to 7.

The nitrogen content in the interior of the steel sheet is defined as a nitrogen content in a region obtained by removing a potion by a depth of 5 μm from each of front and back surfaces of the steel sheet by chemical polishing. The amount of nitriding in the interior of the steel sheet corresponds to a difference between the nitrogen content in the entire steel sheet before final annealing and the nitrogen content in the interior of the steel sheet after final annealing. The amount of nitriding in the entire steel sheet corresponds to a difference between the nitrogen content in the entire steel sheet before final annealing and the nitrogen content in the entire steel sheet after final annealing. The nitrogen content was measured by wet chemical analysis. The number of nitrides containing chromium precipitated was examined using cross-sectional SEM images with a magnification of 5,000.

TABLE 3

| | Composition (Mass basis) | | | | | | | | | | | | |
|---|---|---|---|---|---|---|---|---|---|---|---|---|---|
| Steel ID | C (ppm) | Si (%) | Mn (%) | P (%) | S (ppm) | Al (%) | N (ppm) | O (ppm) | Sb (%) | Sn (%) | Ti (%) | Nb (%) | Cr (%) |
| A | 13 | 3.0 | 0.01 | 0.002 | 10 | 0.005 | 14 | 18 | ≦0.001 | ≦0.001 | ≦0.001 | ≦0.001 | 0.001 |
| B | 18 | 2.96 | 0.02 | 0.002 | 10 | 0.55 | 11 | 15 | 0.03 | ≦0.001 | ≦0.001 | ≦0.001 | 0.001 |
| C | 15 | 3.35 | 0.01 | 0.002 | 10 | 0.005 | 16 | 11 | ≦0.001 | ≦0.001 | ≦0.001 | ≦0.001 | 3.01 |
| D | 11 | 3.48 | 0.01 | 0.002 | 10 | 0.004 | 48 | 17 | ≦0.001 | 0.08 | ≦0.001 | ≦0.001 | 2.95 |
| E | 9 | 3.2 | 0.01 | 0.001 | 10 | 0.005 | 8 | 10 | 0.045 | ≦0.001 | ≦0.001 | ≦0.001 | 3.0 |
| F | 11 | 3.3 | 0.01 | 0.1 | 15 | 0.005 | 9 | 18 | ≦0.001 | 0.065 | ≦0.001 | ≦0.001 | 2.98 |
| G | 18 | 2.9 | 0.02 | 0.001 | 10 | 0.55 | 28 | 14 | ≦0.001 | ≦0.001 | ≦0.001 | ≦0.001 | 3.2 |
| H | 18 | 3.1 | 0.3 | 0.002 | 10 | 0.98 | 21 | 16 | ≦0.001 | ≦0.001 | ≦0.001 | ≦0.001 | 3.05 |
| I | 20 | 3.4 | 0.02 | 0.001 | 10 | 0.35 | 27 | 18 | ≦0.001 | 0.01 | ≦0.001 | ≦0.001 | 3.0 |
| J | 16 | 3.0 | 0.02 | 0.001 | 10 | 0.65 | 19 | 15 | 0.02 | 0.03 | ≦0.001 | ≦0.001 | 3.04 |
| K | 21 | 3.0 | 0.01 | 0.002 | 10 | 0.005 | 14 | 16 | ≦0.001 | ≦0.001 | ≦0.001 | ≦0.001 | 4.5 |
| L | 18 | 3.1 | 0.01 | 0.001 | 10 | 0.005 | 5 | 14 | 0.05 | ≦0.001 | ≦0.001 | ≦0.001 | 4.45 |
| M | 12 | 3.05 | 0.01 | 0.001 | 15 | 0.44 | 53 | 14 | ≦0.001 | ≦0.001 | ≦0.001 | ≦0.001 | 4.4 |
| N | 25 | 4.05 | 0.3 | 0.1 | 10 | 0.5 | 20 | 10 | ≦0.001 | 0.05 | ≦0.001 | ≦0.001 | 3.05 |
| O | 19 | 3.4 | 0.02 | 0.001 | 15 | 0.35 | 14 | 18 | 0.04 | ≦0.001 | ≦0.001 | ≦0.001 | 4.1 |
| P | 10 | 3.1 | 0.02 | 0.001 | 15 | 0.7 | 17 | 13 | ≦0.001 | ≦0.001 | ≦0.001 | ≦0.001 | 4.49 |
| Q | 9 | 4.5 | 0.01 | 0.002 | 7 | 0.005 | 10 | 11 | ≦0.001 | ≦0.001 | ≦0.001 | ≦0.001 | 4.0 |
| R | 11 | 4.45 | 0.01 | 0.001 | 10 | 0.005 | 11 | 18 | ≦0.002 | 0.07 | ≦0.001 | ≦0.001 | 3.9 |
| S | 24 | 4.2 | 0.01 | 0.001 | 10 | 0.7 | 28 | 20 | ≦0.001 | 0.03 | ≦0.001 | ≦0.001 | 4.01 |
| T | 21 | 4.4 | 0.01 | 0.001 | 10 | 0.45 | 18 | 18 | ≦0.001 | ≦0.001 | ≦0.001 | ≦0.001 | 3.78 |
| U | 19 | 4.51 | 0.02 | 0.0015 | 7 | 0.55 | 18 | 13 | 0.03 | 0.02 | ≦0.001 | ≦0.001 | 3.6 |
| V | 7 | 5.6 | 0.01 | 0.001 | 15 | 0.005 | 6 | 20 | 0.05 | 0.03 | ≦0.001 | ≦0.001 | 5.5 |
| W | 20 | 3.3 | 0.01 | 0.002 | 19 | 0.3 | 50 | 21 | 0.01 | ≦0.001 | ≦0.001 | ≦0.001 | 3.1 |

TABLE 4

| Steel ID | Electrical resistivity (μΩcm) | Thickness (mm) | Final annealing conditions: Annealing atmosphere | Final annealing conditions: Annealing temperature (° C.) | Iron loss $W_{10/1k}$ (W/kg) | Amount of nitriding in entire steel sheet (ppm) | Amount of nitriding in interior of steel sheet (ppm) | Nitrogen content in interior of steel sheet (ppm) | Number of nitrides containing chromium precipitated (per $mm^2$) | Remarks |
|---|---|---|---|---|---|---|---|---|---|---|
| A | 47.74 | 0.25 | $N_2$:$H_2$ = 70:30 | 980 | 47.98 | 2 | 1 | 15 | <100 | CE |
| B | 51.66 | 0.25 | $N_2$:$H_2$ = 70:30 | 980 | 46.23 | 5 | 2 | 13 | <100 | CE |
| C | 68.52 | 0.25 | $N_2$:$H_2$ = 70:30 | 980 | 49.31 | 30 | 28 | 44 | $3.5\times10^5$ | CE |
| | 68.52 | 0.25 | $N_2$:$H_2$:Ar = 10:50:40 | 980 | 41.95 | 1 | 0 | 16 | 1,200 | EP |
| | 68.52 | 0.25 | Ar | 980 | 41.01 | −11 | −11 | 5 | <100 | EP |
| D | 69.62 | 0.25 | $N_2$:$H_2$ = 70:30 | 980 | 48.26 | 3 | 0 | 48 | $4.2\times10^5$ | CE |
| E | 66.78 | 0.25 | $N_2$:$H_2$ = 25:75 | 980 | 41.98 | 0 | 0 | 8 | 500 | EP |
| | 66.78 | 0.25 | $N_2$:$H_2$ = 70:30 | 980 | 42.05 | 2 | 1 | 9 | 800 | EP |
| | 66.78 | 0.25 | $N_2$:$H_2$ = 95:5 | 980 | 47.85 | 15 | 14 | 22 | 7,500 | CE |
| | 66.78 | 0.25 | Ar | 980 | 41.89 | 1 | 0 | 8 | <100 | EP |
| F | 67.79 | 0.25 | $N_2$:$H_2$ = 60:40 | 980 | 41.49 | 2 | 0 | 9 | 900 | EP |
| | 67.79 | 0.25 | $N_2$:$H_2$ = 70:30 | 980 | 41.56 | 3 | 0 | 9 | 1,000 | EP |
| | 67.79 | 0.25 | $N_2$:$H_2$ = 80:20 | 980 | 41.76 | 4 | 2 | 11 | 1,200 | EP |
| | 67.79 | 0.25 | $N_2$:$H_2$ = 95:5 | 980 | 47.36 | 18 | 16 | 25 | $1.2\times10^4$ | CE |
| | 67.79 | 0.25 | $N_2$ | 980 | 47.85 | 20 | 19 | 28 | $2.2\times10^4$ | CE |

CE: Comparative Example
EP: Example of Present Invention

TABLE 5

| Steel ID | Electrical resistivity (μΩcm) | Thickness (mm) | Final annealing conditions: Annealing atmosphere | Final annealing conditions: Annealing temperature (° C.) | Iron loss $W_{10/1k}$ (W/kg) | Amount of nitriding in entire steel sheet (ppm) | Amount of nitriding in interior of steel sheet (ppm) | Nitrogen content in interior of steel sheet (ppm) | Number of nitrides containing chromium precipitated (per $mm^2$) | Remarks |
|---|---|---|---|---|---|---|---|---|---|---|
| G | 68.91 | 0.25 | $N_2$:$H_2$ = 40:60 | 980 | 41.58 | 20 | 0 | 28 | 600 | EP |
| | 68.91 | 0.25 | $N_2$:$H_2$ = 70:30 | 980 | 41.77 | 28 | 2 | 30 | 1,200 | EP |
| | 68.91 | 0.25 | $N_2$:$H_2$ = 95:5 | 980 | 47.27 | 30 | 15 | 43 | 6,000 | CE |
| | 68.91 | 0.25 | Ar | 980 | 40.55 | 1 | 0 | 28 | <100 | EP |
| H | 73.74 | 0.25 | $N_2$:$H_2$ = 65:35 | 980 | 38.95 | 30 | 3 | 24 | <100 | EP |
| | 73.74 | 0.25 | $N_2$:$H_2$ = 70:30 | 980 | 39.05 | 31 | 3 | 24 | <100 | EP |
| | 73.74 | 0.25 | $N_2$:$H_2$:Ar = 60:20:20 | 980 | 39.15 | 26 | 2 | 23 | <100 | EP |
| | 73.74 | 0.25 | Ar | 980 | 38.89 | 0 | 0 | 21 | <100 | EP |
| | 73.74 | 0.25 | $N_2$ | 980 | 45.64 | 33 | 21 | 42 | $2.0\times10^4$ | CE |
| I | 71.78 | 0.25 | $N_2$:$H_2$ = 70:30 | 980 | 39.56 | 5 | 1 | 28 | <100 | EP |
| | 71.78 | 0.25 | $N_2$:$H_2$ = 95:5 | 980 | 45.59 | 23 | 15 | 42 | 7,000 | CE |
| | 71.78 | 0.25 | $N_2$ | 980 | 45.92 | 28 | 20 | 47 | $1.5\times10^4$ | CE |
| | 71.78 | 0.25 | Ar | 980 | 39.54 | 0 | 0 | 27 | <100 | EP |
| | 71.78 | 0.25 | $N_2$:$NH_3$ = 40:60* | 980 | 39.51 | 3 | 1 | 28 | <100 | EP |
| | 71.78 | 0.25 | $N_2$:$NH_3$ = 94:6** | 980 | 45.69 | 25 | 16 | 43 | 8,000 | CE |
| J | 69.92 | 0.25 | $N_2$:$H_2$ = 70:30 | 980 | 40.32 | 6 | 1 | 20 | <100 | EP |
| | 69.92 | 0.25 | $N_2$:$H_2$ = 80:20 | 980 | 40.48 | 7 | 2 | 21 | <100 | EP |
| | 69.92 | 0.25 | Ar | 980 | 40.16 | 0 | 0 | 19 | <100 | EP |

*percent by volume in total in terms of nitrogen gas = 55%
**percent by volume in total in terms of nitrogen gas = 95.5%

TABLE 6

| Steel ID | Electrical resistivity (μΩcm) | Thickness (mm) | Final annealing conditions: Annealing atmosphere | Final annealing conditions: Annealing temperature (° C.) | Iron loss $W_{10/1k}$ (W/kg) | Amount of nitriding in entire steel sheet (ppm) | Amount of nitriding in interior of steel sheet (ppm) | Nitrogen content in interior of steel sheet (ppm) | Number of nitrides containing chromium precipitated (per $mm^2$) | Remarks |
|---|---|---|---|---|---|---|---|---|---|---|
| K | 72.94 | 0.25 | $N_2$:$H_2$ = 60:40 | 980 | 49.99 | 40 | 38 | 52 | $1.2\times10^6$ | CE |
| | 72.94 | 0.25 | $N_2$:$H_2$ = 70:30 | 980 | 50.23 | 43 | 42 | 56 | $1.5\times10^6$ | CE |
| | 72.94 | 0.25 | $N_2$:$H_2$:Ar = 5:40:55 | 980 | 40.45 | −2 | −2 | 12 | 800 | EP |
| | 72.94 | 0.25 | Ar | 980 | 39.66 | −9 | −9 | 5 | <100 | EP |
| L | 73.78 | 0.25 | $N_2$:$H_2$ = 70:30 | 980 | 39.89 | 1 | 1 | 6 | <100 | EP |
| | 73.78 | 0.25 | $N_2$:$H_2$ = 75:25 | 980 | 39.93 | 2 | 1 | 6 | <100 | EP |
| | 73.78 | 0.25 | $N_2$:$H_2$:Ar = 65:10:25 | 980 | 39.75 | 0 | 0 | 5 | <100 | EP |

TABLE 6-continued

| Steel ID | Electrical resistivity (μΩcm) | Thickness (mm) | Final annealing conditions: Annealing atmosphere | Final annealing conditions: Annealing temperature (° C.) | Iron loss $W_{10/1k}$ (W/kg) | Amount of nitriding in entire steel sheet (ppm) | Amount of nitriding in interior of steel sheet (ppm) | Nitrogen content in interior of steel sheet (ppm) | Number of nitrides containing chromium precipitated (per $mm^2$) | Remarks |
|---|---|---|---|---|---|---|---|---|---|---|
| M | 76.42 | 0.25 | $N_2$:$H_2$ = 70:30 | 980 | 48.99 | 38 | 2 | 55 | $8.0 \times 10^5$ | CE |
| N | 80.54 | 0.25 | $N_2$:$H_2$ = 70:30 | 980 | 37.82 | 4 | 1 | 21 | <100 | EP |
| | 80.54 | 0.25 | $N_2$:$H_2$ = 90:10 | 980 | 37.96 | 5 | 5 | 25 | <100 | EP |
| O | 77.94 | 0.25 | $N_2$:$H_2$ = 60:40 | 980 | 38.48 | 3 | 0 | 14 | <100 | EP |
| | 77.94 | 0.25 | $N_2$:$H_2$ = 70:30 | 980 | 38.54 | 4 | 0 | 14 | <100 | EP |
| | 77.94 | 0.25 | $N_2$:$H_2$:Ar = 40:40:20 | 980 | 38.39 | 1 | 0 | 14 | <100 | EP |
| | 77.94 | 0.25 | $N_2$:$NH_3$:$H_2$ = 70:20:10* | 980 | 38.61 | 4 | 1 | 15 | <100 | EP |
| | 77.94 | 0.25 | $NH_3$** | 980 | 38.45 | 2 | 0 | 14 | <100 | EP |
| P | 79.56 | 0.25 | $N_2$:$H_2$ = 70:30 | 980 | 37.95 | 35 | 3 | 20 | <100 | EP |
| | 79.56 | 0.25 | Ar | 980 | 38.41 | 1 | 1 | 18 | <100 | EP |

*percent by volume in total in terms of nitrogen = 75%
**percent by volume in total in terms of nitrogen = 25%

TABLE 7

| Steel ID | Electrical resistivity (μΩcm) | Thickness (mm) | Final annealing conditions: Annealing atmosphere | Final annealing conditions: Annealing temperature (° C.) | Iron loss $W_{10/1k}$ (W/kg) | Amount of nitriding in entire steel sheet (ppm) | Amount of nitriding in interior of steel sheet (ppm) | Nitrogen content in interior of steel sheet (ppm) | Number of nitrides containing chromium precipitated (per $mm^2$) | Remarks |
|---|---|---|---|---|---|---|---|---|---|---|
| Q | 86.94 | 0.15 | $N_2$:$H_2$ = 70:30 | 1,040 | 37.03 | 48 | 47 | 57 | $1.5 \times 10^6$ | CE |
| | 86.94 | 0.15 | $N_2$:$H_2$ = 50:50 | 1,040 | 36.28 | 40 | 40 | 50 | $1.0 \times 10^6$ | CE |
| | 86.94 | 0.15 | $N_2$:$H_2$:Ar = 5:40:55 | 1,040 | 27.12 | 0 | 0 | 10 | 500 | EP |
| | 86.94 | 0.15 | Ar | 1,040 | 26.69 | −5 | −5 | 5 | <100 | EP |
| R | 85.82 | 0.15 | $N_2$:$H_2$ = 70:30 | 1,040 | 27.95 | 3 | 1 | 12 | <100 | EP |
| | 85.82 | 0.15 | $N_2$:$H_2$ = 95:5 | 1,040 | 35.59 | 11 | 10 | 21 | 8.000 | CE |
| S | 89.2 | 0.15 | $N_2$:$H_2$ = 70:30 | 1,040 | 26.84 | 7 | 2 | 30 | <100 | EP |
| | 89.2 | 0.15 | $N_2$ | 1,040 | 34.25 | 19 | 15 | 43 | $1.2 \times 10^4$ | CE |
| T | 88.15 | 0.15 | $N_2$:$H_2$ = 70:30 | 1,040 | 27.12 | 39 | 3 | 21 | <100 | EP |
| | 88.15 | 0.15 | Ar:$H_2$ = 70:30 | 1,040 | 27.04 | 1 | 0 | 18 | <100 | EP |
| U | 89.17 | 0.15 | $N_2$:$H_2$ = 70:30 | 1,040 | 26.31 | 4 | 1 | 19 | <100 | EP |
| | 89.17 | 0.15 | $N_2$:$H_2$ = 80:20 | 1,040 | 26.42 | 4 | 4 | 22 | <100 | EP |
| | 89.17 | 0.15 | $H_2$ | 1,040 | 26.22 | 0 | 0 | 18 | <100 | EP |
| V | 107.66 | 0.15 | $N_2$:$H_2$ = 70:30 | 1,040 | 20.85 | 3 | 2 | 8 | <100 | EP |
| | 107.66 | 0.15 | $N_2$ | 1,040 | 26.41 | 15 | 16 | 22 | $1.0 \times 10^4$ | CE |
| | 107.66 | 0.15 | Ar | 1,040 | 20.23 | 1 | 1 | 7 | <100 | EP |
| W | 70.82 | 0.25 | $N_2$:$H_2$ = 70:30 | 980 | 47.15 | 2 | 1 | 51 | $8.0 \times 10^4$ | CE |

With respect to steels A and B to which Cr is not added, since the electrical resistivity is out of the range of the present invention, the reduction in iron loss is insufficient. With respect to steels D, M, and W in which the nitrogen content in steel is out of the range of the present invention, even if Al, Sn, or Sb is added, nitrides containing chromium are precipitated, and the iron loss is unsatisfactory.

With respect to steels C, K and Q to which Al, Sb, and Sn are not added, when the percentage of nitriding gas (herein, the nitrogen partial pressure) is not controlled, nitrides containing chromium are precipitated due to nitriding during annealing, and the iron loss is unsatisfactory. On the other hand, when the nitrogen partial pressure is controlled to be low by setting the annealing atmosphere to be an Ar atmosphere or a low-nitrogen atmosphere, precipitation of nitrides containing chromium is inhibited, and satisfactory iron loss is shown.

With respect to steels E, F, L, R, and V to which at least one of Sn and Sb is added, when the annealing atmosphere is controlled within the range of the present invention, precipitation of nitrides containing chromium and surface oxidation of the steel sheet are inhibited, and satisfactory iron loss is shown. On the other hand, when the atmosphere is not controlled and annealing is performed with high nitrogen partial pressure, the nitriding-inhibiting effect due to the addition of Sn and/or Sb becomes insufficient, the amount of precipitation of nitrides containing chromium is not controlled within the range of the present invention, and the iron loss is unsatisfactory.

With respect to steels G, H, P, and T to which Sb and Sn are not added and Al is added, since AlN is formed on the outermost layer in the steel sheet due to nitriding, the nitrogen content after annealing is increased. However, because of the formation of AlN, the nitrogen content in the interior of the steel sheet is not increased. Therefore, when the annealing atmosphere is controlled besides the addition of Al, nitriding is inhibited and satisfactory iron loss is shown. On the other hand, when the atmosphere is not controlled and annealing is performed with high nitrogen partial pressure, the nitriding-inhibiting effect due to the addition of Al becomes insufficient, precipitation of the nitrides containing chromium is not controlled within the range of the present invention, and the iron loss is unsatisfactory.

With respect to steels I, J, N, O, S, and U to which Sn and/or Sb and Al are added in combination, precipitation of nitrides containing chromium due to nitriding is inhibited because of the inhibition of nitriding by the addition of Sn and/or Sb and the formation of AlN on the outermost surface in the steel sheet by the addition of Al, and satisfactory magnetic properties are shown. On the other hand, when the atmosphere is not controlled, and annealing is performed with high nitrogen partial pressure, the nitriding-inhibiting effect due to the addition Sn and/or Sb and Al in combination becomes insufficient, the amount of precipitation of nitrides containing chromium is not controlled within the range of the present invention, and the iron loss is unsatisfactory.

With respect to steels to which at least one of Sn, Sb, and Al is added, of course, satisfactory iron loss is shown even when annealing is performed in a 100% non-nitriding atmosphere, such as in an Ar atmosphere, in which nitriding does not occur.

Example 2

With respect to steels Q, R, S, and T shown in Table 3, the final thickness was set at 0.15 mm by the process described in Example 1, final annealing was then performed at 900° C. for 10 seconds, and the iron loss at a higher-frequency range was evaluated. The measurement results are shown in Table 8.

TABLE 8

| Steel ID | Electrical resistivity (μΩcm) | Thickness (mm) | Final annealing conditions: Annealing atmosphere | Final annealing conditions: Annealing temperature (° C.) | Iron loss $W_{0.5/20k}$ (W/kg) | Number of nitrides containing chromium precipitated (per mm$^2$) | Remarks |
|---|---|---|---|---|---|---|---|
| Q | 86.94 | 0.15 | $N_2$:$H_2$ = 70:30 | 900 | 10.25 | $8 \times 10^5$ | CE |
| | 86.94 | 0.15 | $N_2$:$H_2$ = 20:80 | 900 | 8.76 | 1,500 | EP |
| | 86.94 | 0.15 | Ar | 900 | 8.42 | <100 | EP |
| R | 85.82 | 0.15 | $N_2$:$H_2$ = 70:30 | 900 | 8.64 | <100 | EP |
| | 85.82 | 0.15 | $N_2$:$H_2$ = 85:15 | 900 | 8.68 | <100 | EP |
| | 85.82 | 0.15 | $N_2$ | 900 | 9.75 | 7,000 | CE |
| S | 89.2 | 0.15 | $N_2$:$H_2$ = 70:30 | 900 | 8.43 | <100 | EP |
| | 89.2 | 0.15 | $N_2$:$H_2$ = 50:50 | 900 | 8.39 | <100 | EP |
| | 89.2 | 0.15 | $H_2$ | 900 | 8.29 | <100 | EP |
| | 89.2 | 0.15 | $N_2$:$H_2$ = 90:10 | 900 | 8.62 | 500 | EP |
| T | 88.15 | 0.15 | $N_2$:$H_2$ = 70:30 | 900 | 8.55 | <100 | EP |
| | 88.15 | 0.15 | Ar | 900 | 8.46 | <100 | EP |
| | 88.15 | 0.15 | $N_2$ | 900 | 9.68 | 6,000 | CE |

CE: Comparative Example
EP: Example of Present Invention

As in Example 1, with respect to steel Q to which Al, Sb, and Sn are not added, when the annealing atmosphere is not controlled, nitrides containing chromium are precipitated due to nitriding during annealing, and the iron loss is unsatisfactory. On the other hand, when the annealing atmosphere is set to be an Ar atmosphere or a low-nitrogen atmosphere to inhibit nitriding, precipitation of nitrides containing chromium is inhibited, and satisfactory iron loss is shown. Similarly, with respect to steels R, S, and T to which at least one of Al, Sn, and Sb is added, when annealing is performed with high nitrogen partial pressure without controlling the atmosphere, the nitriding-inhibiting effect due to the addition of Al, Sn, and Sb becomes insufficient, the amount of precipitation of nitrides containing chromium is not controlled within the range of the present invention, and iron loss is unsatisfactory. On the other hand, when the annealing atmosphere is controlled, nitriding is inhibited, the amount of precipitation of nitrides containing chromium is within the range of the present invention, and satisfactory iron loss is shown.

ADVANTAGES OF THE INVENTION

As described above, non-oriented electrical steel sheets of the present invention have excellent high-frequency magnetic properties. The steel sheets of the present invention are most suitable for devices used in the high-frequency range, for example, electric car motors, power generators for gas microturbines, and high-frequency reactors, and the industrial values thereof are great.

The invention claimed is:

1. An Fe—Cr—Si based non-oriented electrical steel sheet comprising:

2.5% to 10% by mass of Si;
1.5% to 20% by mass of Cr;
0.1% to 2% by mass of Al;
0.006% by mass or less of C;
0.0021% by mass to 0.004% by mass of N;
0.005% by mass or less of S;
0.005% by mass or less of Ti;
0.005% by mass or less of Nb; and
the balance being Fe and incidental impurities, wherein the electrical resistivity of the steel is 60 μΩcm or more, and the number of nitrides containing chromium per mm$^2$ in the interior of the steel sheet is 2,500 or less.

2. An Fe—Cr—Si based non-oriented electrical steel sheet comprising:

2.5% to 10% by mass of Si;
1.5% to 20% by mass of Cr;
0.1% to 2% by mass of Al;
0.006% by mass or less of C;
0.0021% by mass to 0.004% by mass of N;
0.005% by mass or less of S;
0.005% by mass or less of Ti;
0.005% by mass or less of Nb;

at least one of 0.005% to 1% by mass of Sb and 0.005% to 1% by mass of Sn; and the balance being Fe and incidental impurities, wherein the electrical resistivity of the steel is 60 μΩcm or more, and the number of nitrides containing chromium per $mm^2$ in the interior of the steel sheet is 2,500 or less.

3. The Fe—Cr—Si based non-oriented electrical steel sheet according to claim 1 or 2, further comprising at least one of 1% by mass or less of Mn and 1% by mass or less of P.

4. A method for producing an Fe—Cr—Si based non-oriented electrical steel sheet comprising the steps of:

casting molten steel containing 2.5% to 10% by mass of Si and 1.5% to 20% by mass of Cr;

subjecting the cast steel to rolling process including cold rolling (including warm rolling, hereinafter the same); and subjecting the resulting rolled steel sheet to final annealing, wherein the nitriding gas content in the final annealing atmosphere is controlled to 5 percent by volume or more and less than 30 percent by volume in total in terms of nitrogen gas.

5. A method for producing an Fe—Cr—Si based non-oriented electrical steel sheet comprising the steps of:

casting molten steel containing 2.5% to 10% by mass of Si, 1.5% to 20% by mass of Cr, and at least one of more than 0.04% to 1% by mass of Sb and more than 0.06% to 1% by mass of Sn;

subjecting the cast steel to rolling process including cold rolling; and subjecting the resulting rolled steel sheet to final annealing, wherein the nitriding gas content in the final annealing atmosphere is controlled to 60 percent by volume or more and less than 95 percent by volume in total in terms of nitrogen gas.

6. A method for producing an Fe—Cr—Si based non-oriented electrical steel sheet comprising the steps of:

casting molten steel containing 2.5% to 10% by mass of Si, 1.5% to 20% by mass of Cr, and 0.1% to 2% by mass of Al;

subjecting the cast steel to rolling process including cold rolling; and subjecting the resulting rolled steel sheet to final annealing, wherein the nitriding gas content in the final annealing atmosphere is controlled to 60 percent by volume or more and less than 95 percent by volume in total in terms of nitrogen gas.

7. A method for producing an Fe—Cr—Si based non-oriented electrical steel sheet comprising the steps of:

casting molten steel containing 2.5% to 10% by mass of Si, 1.5% to 20% by mass of Cr, 0.1% to 2% by mass of Al, and at least one of 0.005% to 1% by mass of Sb and 0.005% to 1% by mass of Sn;

subjecting the cast steel to rolling process including cold rolling; and subjecting the resulting rolled steel sheet to final annealing, wherein the nitriding gas content in the final annealing atmosphere is controlled to 60 percent by volume or more and less than 95 percent by volume in total in terms of nitrogen gas.

8. The method for producing the Fe—Cr—Si based non-oriented electrical steel sheet according to any one of claims 4 to 7, wherein the rolling process comprises the substeps of:

hot-rolling the cast steel slab;

subjecting the resulting hot-rolled sheet to hot-rolled sheet annealing as necessary; and subjecting the hot-rolled sheet or annealed hot-rolled sheet to cold rolling once, or twice or more with intermediate annealing being interposed therebetween.

* * * * *

UNITED STATES PATENT AND TRADEMARK OFFICE

CERTIFICATE OF CORRECTION

PATENT NO. : 7,465,364 B2
APPLICATION NO. : 10/538501
DATED : December 16, 2008
INVENTOR(S) : Omura et al.

It is certified that error appears in the above-identified patent and that said Letters Patent is hereby corrected as shown below:

In Column 14:

Please change "$H_{2 = 40:40:20}$" to -- $H_2$ = 40:40:20 --.

Signed and Sealed this

Twenty-second Day of September, 2009

David J. Kappos

David J. Kappos
*Director of the United States Patent and Trademark Office*